United States Patent [19]

Carmody

[11] 3,938,661

[45] Feb. 17, 1976

[54] PACKING BRACE

[75] Inventor: John Maurice Carmody, Palos Heights, Ill.

[73] Assignee: Republic Packaging Corporation, Chicago, Ill.

[22] Filed: Oct. 17, 1974

[21] Appl. No.: 515,566

[52] U.S. Cl. ..... 206/523; 217/53; 229/14 C

[51] Int. Cl.[2] ..... B65D 81/04; B65D 85/30

[58] Field of Search ..... 206/320, 326, 521, 523; 217/26.5, 35, 53; 229/14 C

[56] References Cited

UNITED STATES PATENTS

| | | | |
|---|---|---|---|
| 3,404,826 | 10/1968 | Carmody | 206/523 X |
| 3,531,040 | 9/1970 | Myny | 206/523 X |
| 3,564,811 | 2/1971 | Freeman | 206/523 X |
| 3,572,574 | 3/1971 | Mears | 229/14 C |
| 3,695,421 | 10/1972 | Wood | 229/14 C X |
| 3,854,650 | 12/1974 | Hanaue | 217/53 X |

*Primary Examiner*—William Price
*Assistant Examiner*—Steven E. Lipman
*Attorney, Agent, or Firm*—Dominik, Knechtel, Godula & Demeur

[57] ABSTRACT

A packing brace is disclosed which is formed of resilient material and is structured as an integral band formed by a first section having a substantially U-shaped cross section and including an outer and inner bracing surface, a second section having a substantially U-shaped cross section and also including an outer and inner bracing surface, a pair of integrally formed hinge members pivotally joined to and interconnecting the first and second hinged sections between opposed legs of the U-shaped sections, each of the hinge members further including a centrally disposed hinge joint, and the first and second sections and the hinge members being integrally formed as a unitary construction.

5 Claims, 8 Drawing Figures

PACKING BRACE

BACKGROUND OF THE INVENTION

A variety of packaging braces, fillers and cushioning pads are known in the art, and in point of fact, the packaging art is well developed. In most instances, a particular type of packaging brace or end cap is constructed to accomplish a specific function. For example, corner cushioning pads are well known in the art such as the type depicted in U.S. Pat. No. 3,555,137 assigned to the assignee of the present invention. Other types of packing fillers and braces are designed to accommodate an article within a container and also designed to be energy absorbent such that relatively fragile articles may be packaged without damage during transport. An example of this type of packaging brace is shown in U.S. Pat. No. 3,695,421. As depicted therein, it is intended that the packaging braces retain a rectangular article between a plurality of four of such braces after which the article with the packaging braces installed thereon are positioned within a container.

Other examples of packaging fillers and energy absorbent packaging pads is shown in U.S. Pat. No. 3,531,040 wherein a foam plastic buffer packaging material is disclosed intended to surround the outer periphery of an article packaged within another container. Similar concepts are shown in U.S. Pat. No. 3,565,243 and U.S. Pat. No. 3,404,826 wherein it is intended to encompass or envelope the particular article to be packaged between the packaging brace utilized after which the same are positioned into a container for shipment and transport. It is apparent from a review of the prior art noted above as well as presently available packaging materials that generally, such materials are designed for a specific function or purpose. Often times, such packaging materials are specifically designed for a product, per se, as is well known in the electronics industry wherein packaging materials are generally designed to accommodate a particular style of radio receiver or television receiver or the like. It is therefore apparent that in most instances such packaging materials have a unitary use, unitary in the sense that the packaging brace can only be employed with a particular product. Similarly, in many cases, the packaging brace is constructed to accommodate either articles having rectangular corners or those which are cylindrical in configuration. Therefore, depending upon the article to be packaged and the particular configuration thereof, the packaging material must be varied. It is therefore clear that when one employs packaging materials having a unitary function, the cost of providing such package fillers, braces or end caps becomes a significant factor.

In addition to the above drawbacks it is to be noted that most of the packaging fillers or end caps or braces described in the patented art are presently commercially available the same tend to be formed as fairly rigid items and do not generally tend to have any ability to be adapted to a particular article to be packaged. For example, the cushioning unit shown in U.S. Pat. No. 3,572,574 relates to two rigid end caps which are designed to be employed with a rectangular article to be packaged within another container. Clearly, the end caps employed cannot be adapted to a different sized package, or a different sized article. Of the types of packaging braces and/or fillers which are available and which do permit movement generally such units merely permit flexing the same around corners within the package wherein the article is to be packed.

SUMMARY OF THE INVENTION

The present invention provides a packaging brace designed to permit the same to be employed with a wide variety of articles regardless of the exterior configuration of the article to be packaged, and further regardless of whether the packing brace is intended to be used as an end cap, filler or a side brace. The backing brace of the present invention provides a band shaped structure formed of a resilient energy absorbent material which is die cut from a single roll of the material employed, and is formed by a first section having a substantially U-shaped cross section and including both an outer and inner bracing surface, a second section having a substantially U-shaped cross section and also including an outer and inner bracing surface and a pair of integrally formed hinge members pivotally joined to and interconnecting the first and second sections between opposed legs of the U-shaped sections. Each of the hinge members further includes a centrally disposed hinge joint thereby permitting the two sections as well as the hinge members to be moved in lateral directions as well as throughout an arcuate pathway, one with respect to the other. In addition, the entire structure as defined above including a first section, a second section and hinge members are integrally formed as a single unitary construction. Another feature of the invention is the provision of bracing blocks positioned along the outer bracing surfaces of the packing brace thereby permitting the subject packing brace to brace against the inner walls of a container in which an article to be packaged is contained.

OBJECTS AND ADVANTAGES

In view of the above discussion, it is therefore the principal object of the present invention to provide a packing brace which is economical in cost while at the same time being multi-purpose in terms of utility since the subject packing brace may be employed with both rectangular articles as well as cylindrical articles which are intended for packaging in a container.

A further object of the invention is to provide a packing brace which is formed by two sections interconnected by hinge members joined to and interconnecting the two sections such that the two sections are permitted movement with respect to one another in a lateral direction as well as in an arcuate path throughout an arc of 180°.

In connection with the foregoing object, it is another object of the invention to provide a packing brace of the type described wherein each of the hinge members further includes a hinge joint positioned centrally thereof such that the center portion of the hinge member is pivotally constructed thereby to accommodate the lateral as well as arcuate movement of the two sections with repsect to one another.

Another object of the invention is to provide a packing brace of the type described above wherein the outer bracing surfaces of the packing brace is provided with a plurality of bracing blocks formed integrally therewith to permit the subject packing brace to be snugly secured against the inner walls of a container for accommodating the article to be packaged.

Still a further object of the invention is to provide a packing brace of the type described wherein the central portion of the packing brace is open thereby permitting the packing brace to be utilized for completely encompassing an article to be packaged as well as permitting utilization as an end cap or end filler for a container.

Further features of the invention pertain to the particular arrangement of the elements and parts whereby the above-outlined and additional operating features thereof are attained.

The invention, both as to its organization and method of operation, together with further objects and advantages thereof will best be understood by reference to the following specification, taken in connection with the accompanying drawings in which.

Figure 4:
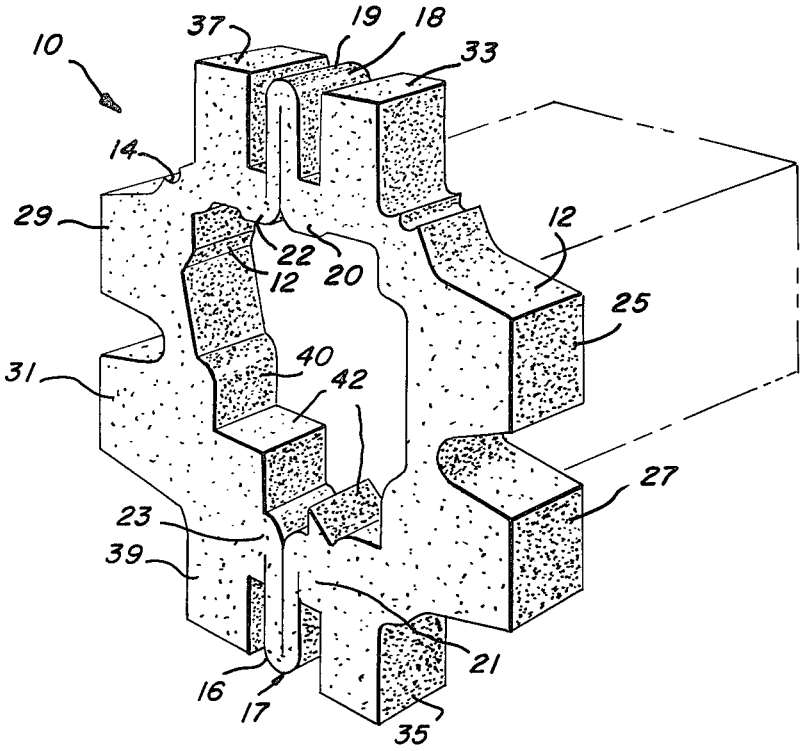
FIG. 4 is a perspective view showing the subject packing brace with the two sections fully retracted together.
Figure 5:
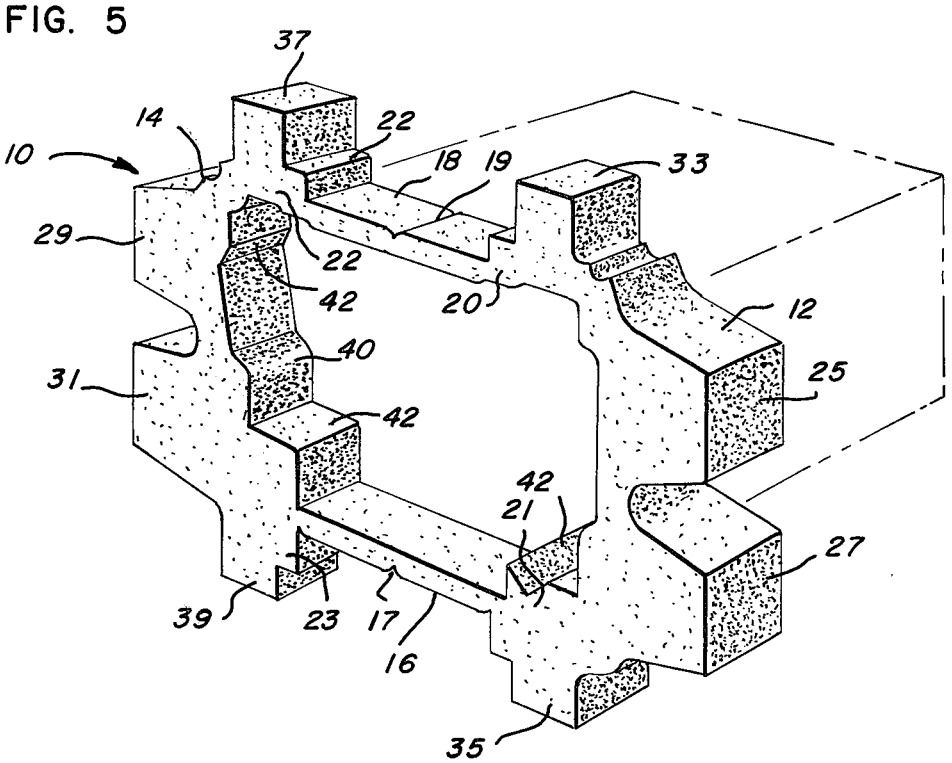
FIG. 5 is a perspective view showing the subject packing brace having the two sections thereof fully extended from one another.

Referring now to the figures, especially FIGS. 4 and 5 of the drawings, the packing brace generally denoted by the numeral 10 is shown to be formed as a unitary construction. The packing brace 10 is formed by a first section 12 and a second section 14, each of the first and second sections 12 and 14 respectively having a substantially U-shaped cross section. The two sections 12 and 14 are joined by a pair of hinge members 16 and 18 respectively which join to and interconnect the two sections 12 and 14 at the leg portions 20 and 21, 22 and 23 respectively. Each of the hinge members 16 and 18 further includes a centrally disposed hinge joint 17 and 19 respectively such that the hinge members 16 and 18 are constructed to be pivotal along their central axis.

Figure 2:
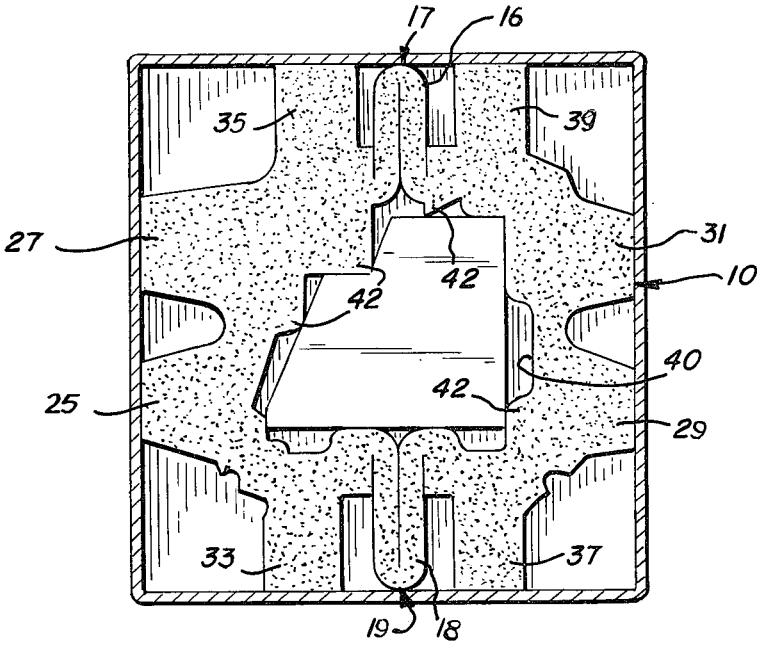
FIG. 2 is a side elevational view, in cross section, showing the subject packing brace accommodating an article wherein the two halves of the packing brace have been moved laterally together to accommodate the article within the container.
Figure 3:
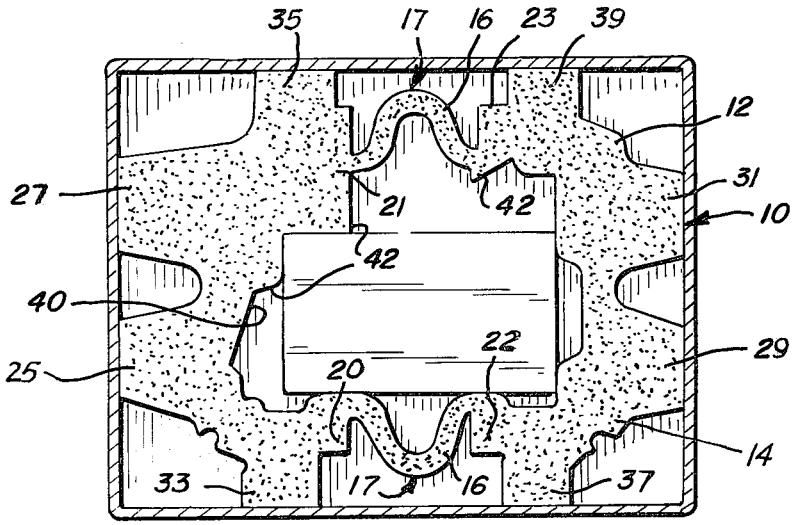
FIG. 3 is a side elevational view, in cross section, showing the subject packing brace employed in connection with a differently sized article with the two sections thereof being held in spaced relation by the article packaged therein.

In the normal resting configuration of the subject packing brace 10 the hinge members 16 and 18 each assume a V-shaped configuration as shown in FIG. 3 of the drawings. The centrally pivotal feature of the hinge members 16 and 18 is shown in both FIGS. 2 and 5 of the drawings. Furthermore, it will be noted that the hinge members 16 and 18 interconnect with and join to the leg portions 20, 21, 22 and 23 of the two sections 12 and 14 respectively in a manner which permits the pivotal movement of the hinge members 16 and 18 with respect to both of the sections 12 and 14.

The exterior surfaces of the two sections 12 and 14 are shown to include a side bracing block 25 and 27 with respect to section 12 and 29 and 31 with respect to section 14. In addition, the first section 12 is provided with an upper bracing block 33 and a lower bracing block 35, and similarly, the second section 14 is provided with upper and lower bracing blocks 37 and 39 respectively.

Figure 1:
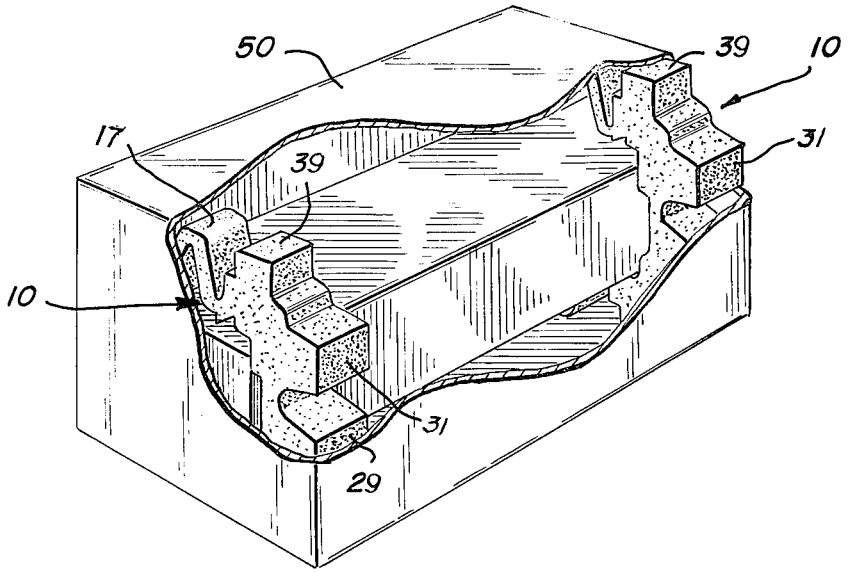
FIG. 1 is a perspective view, partly cut away showing the subject packing brace of the present invention as employed within a container to accommodating an article internally of the packing braces and disposed between a pair of the same.

The packing brace 10 is also shown to be open in its central portion and provided with an interior bracing surface 40 which extends around the entire open portion of the brace 10. As shown in FIG. 1 of the drawings the subject packing brace 10 may be utilized to package an article by surrounding the article with the article braced against the interior bracing surface 40 of the packing brace 10. By employing a pair of such packing braces 10, a fragile article may be packaged within a container 50 as shown in FIG. 1.

As further shown in FIGS. 2 and 3 of the drawings, the configuration of the subject packing brace 10 is such as to permit the packaging of a variety of differently shaped articles. For example, it is noted that in FIG. 2 of the drawings, the article packaged therein has an overall smaller outside configuration as compared to the article depicted in FIG. 3 of the drawings. The packing brace 10 accommodates such smaller articles due to the pivotal movement by the hinge members 16 and 18. It will be observed from FIG. 5 of the drawings that the lateral movement of the two sections 12 and 14 with respect to one another is limited only by the overall length of the respective hinge members 16 and 18.

As further depicted in FIGS. 1 through 3 of the drawings the lateral bracing blocks 25, 27, 29 and 30, as well as the upper and lower bracing blocks 33, 35, 37 and 39 function to brace the articles packaged therein against the interior surfaces of the container 50. In this manner, fragile articles may be securely packaged within a container 50, and due to the material employed in forming the packing brace 10, a great amount of shock may be absorbed without damage to the article packaged therein.

Figure 6:
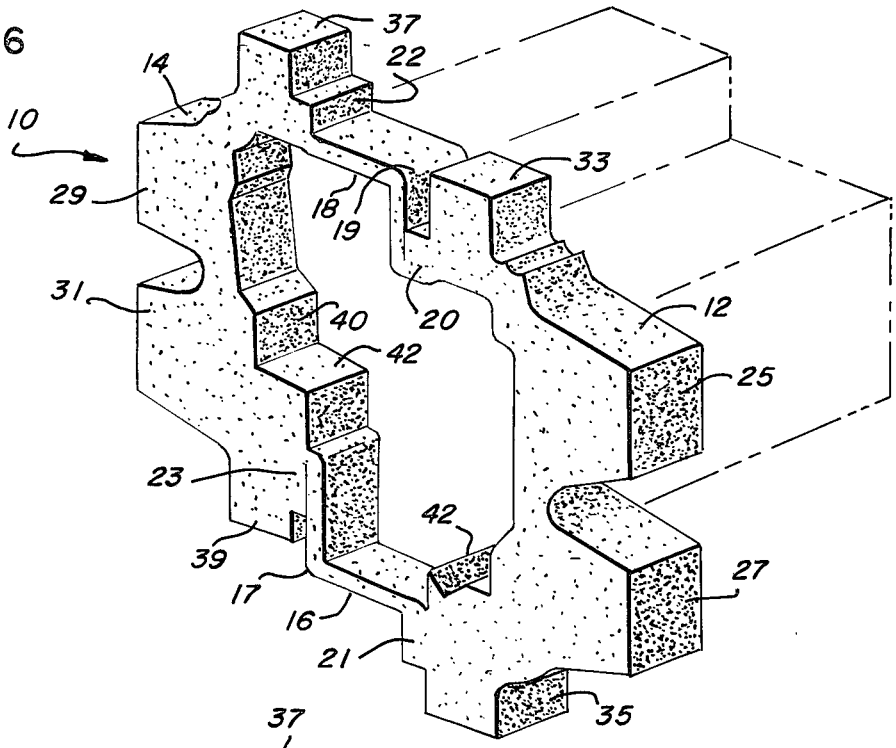
FIG. 6 is a perspective view showing the subject packing brace having the two sections thereof arcuately disposed with respect to one another to accommodate a variously shaped article.
Figure 7:
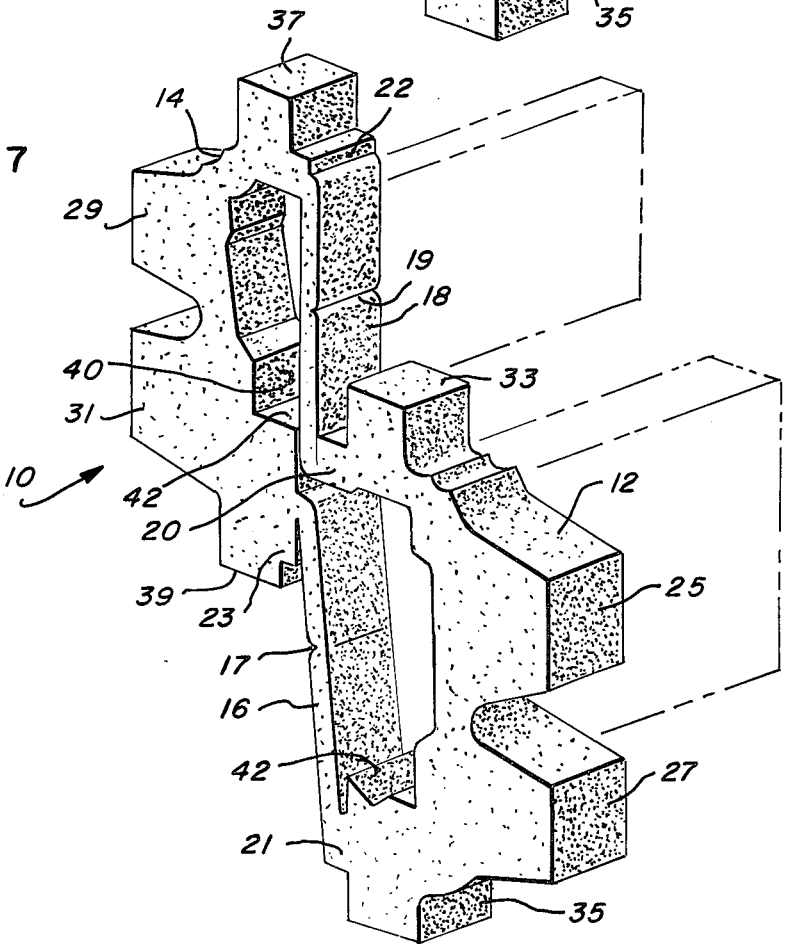
FIG. 7 is a perspective view of the subject packing brace having the two sections move throughout an arc of 180 degrees with respect to one another to accommodate a pair of articles in packing disposition.

As shown in FIGS. 6 and 7 of the drawings, the two sections 12 and 14 of the packing brace 10 are permitted an arcuate type of movement throughout the 180° arc. This is due to the pivotal connection of the hinge members 16 and 18 with the leg portions 20, 21, 22 and 23 of the U-shaped sections 12 and 14. The advantage obtained by having the two sections 12 and 14 arcuately movable with respect to one another is that a wide variety of packaging postures may be achieved with the subject packing brace 10, and in point of fact, the subject packing brace 10 may be employed as an end cap or a filler material in packaging articles as well as for bracing articles in the manner shown in FIGS. 1 through 3 of the drawings.

As is further evident from FIGS. 6 and 7 of the drawings, the arcuate movement of the two sections 12 and 14 with respect to one another permit the packaging of articles which may be variously shaped. For example, in FIG. 6 of the drawings, an article having a stepped configuration may be packaged within the packing brace 10. Alternatively, as shown in FIG. 7 of the drawings, by moving the two sections 12 and 14 respectively throughout a 180° arc with respect to one another, the interior bracing surface 40 forms two separate compartments separated by the hinge members 16 and 18 and thereby accommodates the packaging of two separate articles. The employment of the subject packing brace 10 in this configuration within a container is more expressly shown in FIG. 8 of the drawings.

Figure 8:
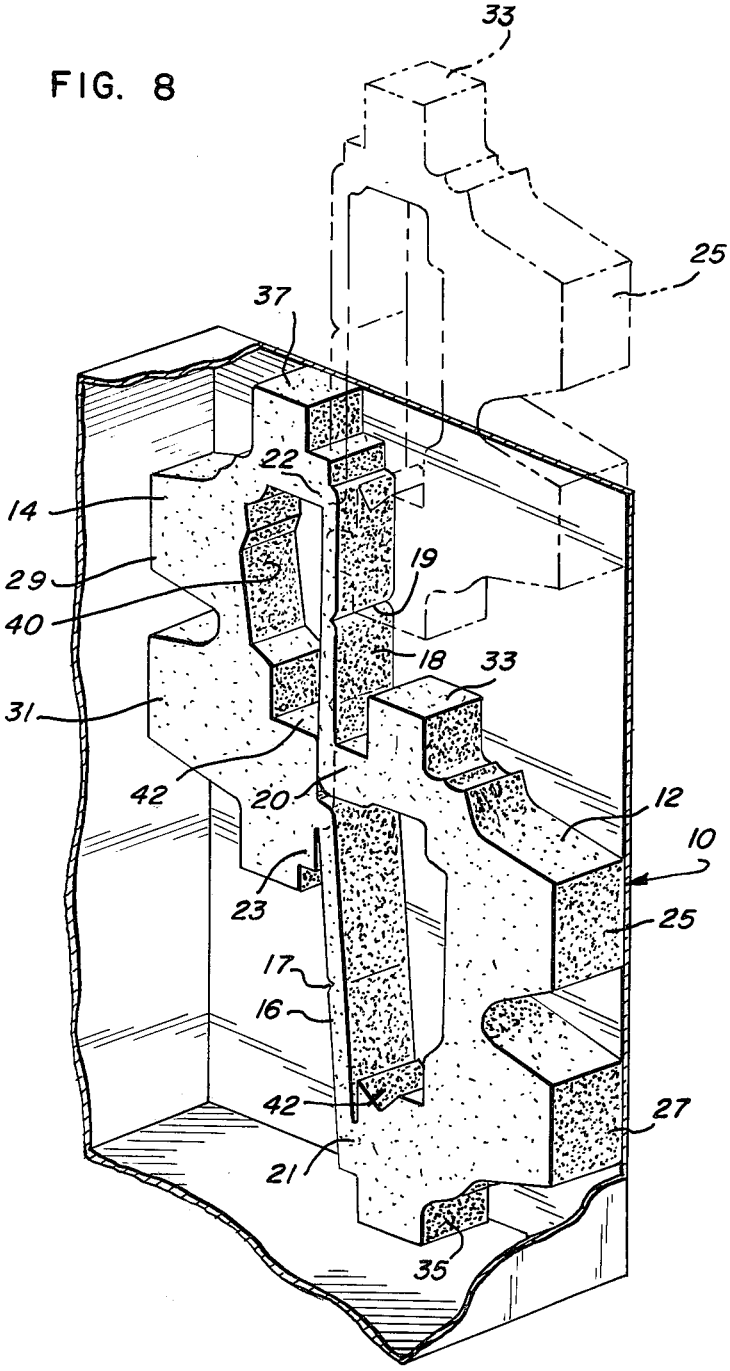
FIG. 8 is a perspective view showing the subject packing brace with the two sections moved arcuately throughout an arc of 180° and contained within a container packaging goods therein.

It will be appreciated from FIGS. 6 through 8 of the drawings that as indicated previously, the subject packing brace 10 may be employed in a wide variety of configurations depending upon the particular article to be packaged and therefore permits a wide latitude of usage.

In terms of the material employed to formulate the subject packing brace 10, it is desired in the preferred embodiment to employ a polyolefin foam which is light weight but highly energy absorbent. Hence, a material such as a polyethylene foam may be conveniently employed. An additional characteristic of such materials and which is successfully employed in the present invention is the flexibility of the material thereby permitting the formation of hinge members integrally formed with the balance of the unit. In terms of the method of producing the subject packing brace 10, the preferred embodiment is die cut from a core of the foam material such that the complete unit is formed as a unitary construction including the two U-shaped half portions 12 and 14 respectively as well as the hinge members 16 and 18. In addition, during the cutting operation, the hinge joints 17 and 19 are formed in the hinge members 16 and 18 such that there is virtually no necessity for any hand labor incident to the production of the subject brace 10. Additionally, and in the preferred embodiment, the interior bracing surface 40 may be provided with bracing ridges 42 at selected locations which function to further brace the article enveloped thereby when properly packaged.

It therefore now becomes apparent that due to the construction of the subject packing brace 10, employing hinge members 16 and 18 integrally formed with the brace 10, a high degree of pivotal movement of the two sections 12 and 14 is permitted such that the subject packing brace 10 may be employed in a variety of usages and for a variety of differently shaped articles.

It will be appreciated, therefore, that the present invention provides a novel packing brace which may be employed in a number of usages and for a variety of differently shaped articles, while still being low in cost and highly efficient in operation. Furthermore, the packing brace of the present invention has the additional advantage of permitting re-use of the same such that the useful life of the packing brace is extended further minimizing the cost to the operator in utilizing the same. It will be appreciated that all of the objects and advantages set forth above are provided by the packing brace of the present invention as well as additional advantages.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. A packing brace for packaging articles comprising, in combination, an integral band of resilient material, said integral band formed by a first section having a substantially U-shaped cross section and including both outer and inner bracing surfaces, a second section having a substantially U-shaped cross section and including both outer and inner bracing surfaces, a pair of integrally formed hinge members pivotally joined to and interconnecting said first and second sections between opposed legs of said U-shaped section, each of said hinge members further including a centrally disposed hinge joint, and said first and second sections and said hinge members being integrally formed as a unitary construction, whereby each of said first and second sections may be moved laterally and arcuately throughout an arc of approximately 180° with respect to one another thereby to accommodate a variety of packaging positions.

2. The packing brace as set forth in claim 1 above, wherein the said packing brace is formed of a resilient polyolefin foam material having the characteristics of being highly shock absorbent.

3. The packing brace as set forth in claim 1 above, wherein each of said first and second sections includes a pair of bracing blocks extending laterally outwardly from said outer bracing surface, and upper and lower bracing blocks extending upwardly and downwardly respectively on said outer bracing surface, whereby movement of said first and second sections relative to one another through said hinge members positions said bracing blocks in a variety of packing positions thereby to permit the bracing of variously shaped articles.

4. The packing brace as set forth in claim 1 above, wherein each of said hinge members assumes a V-shaped configuration when in the normal position.

5. The packing brace as set forth in claim 1 above, wherein the interior portion of said packing brace is open whereby articles may be packed interiorly of said band by positioning said interior bracing surface against the articles to be packaged.

* * * * *